US007628594B2

(12) United States Patent
Nishikata et al.

(10) Patent No.: US 7,628,594 B2
(45) Date of Patent: Dec. 8, 2009

(54) VANE PUMP HAVING A LABYRINTH SEAL AND GAP BETWEEN A TOP SURFACE OF A ROTOR AND A CEILING SURFACE OF A ROTOR CHAMBER THAT IS FORMED BETWEEN UPPER AND LOWER CASES

(75) Inventors: Masaaki Nishikata, Fukuoka (JP); Tsuyoshi Kusakabe, Chikushi (JP); Tsukasa Hojo, Hirakata (JP); Ken Yamamoto, Osaka (JP); Masaki Nagano, Ibaraki (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 11/984,693

(22) Filed: Nov. 21, 2007

(65) Prior Publication Data

US 2008/0219873 A1 Sep. 11, 2008

(30) Foreign Application Priority Data

Nov. 24, 2006 (JP) ..... 2006-317512

(51) Int. Cl.
*F03C 2/00* (2006.01)
*F03C 4/00* (2006.01)
*F04C 15/00* (2006.01)

(52) U.S. Cl. ..... 418/141; 418/77; 418/259; 418/268

(58) Field of Classification Search ..... 418/77, 418/104, 142, 259, 266–268
See application file for complete search history.

(56) References Cited

U.S. PATENT DOCUMENTS

2002/0150494 A1 10/2002 Yamamoto et al.

FOREIGN PATENT DOCUMENTS

| | | |
|---|---|---|
| EP | 1 553 301 | 7/2005 |
| GB | 455 994 | 11/1936 |
| JP | 53-114510 | 10/1978 |
| JP | 58-189388 | 12/1983 |
| JP | 62-179382 | 11/1987 |
| JP | 01-138390 | 5/1989 |
| JP | 07-133776 | 5/1995 |
| JP | 07-279678 | 10/1995 |
| JP | 07-317674 | 12/1995 |
| JP | 14-257044 | 9/2002 |
| WO | 98/01657 | 1/1998 |
| WO | 02/18791 | 3/2002 |

*Primary Examiner*—Theresa Trieu
(74) *Attorney, Agent, or Firm*—Bacon & Thomas, PLLC

(57) ABSTRACT

A vane pump includes a rotor chamber; a rotor eccentrically accommodated in the rotor chamber; a plurality of vanes attached to the rotor, each vane having a leading end adapted to make sliding contact with an inner peripheral surface of the rotor chamber. The vane pump includes working compartments surrounded by inner surfaces of the rotor chamber, an outer peripheral surface of the rotor, and the vanes; an inlet port through which a working fluid is drawn into a working compartment; and an outlet port through which the working fluid is discharged from a working compartment. An engaging portion is formed in a peripheral end portion of a thrust surface of the rotor and an engaged portion with which the engaging portion engages in a non-contact state is formed in an inner surface region of the rotor chamber facing the thrust surface of the rotor in a non-contact state.

12 Claims, 5 Drawing Sheets

VANE PUMP HAVING A LABYRINTH SEAL AND GAP BETWEEN A TOP SURFACE OF A ROTOR AND A CEILING SURFACE OF A ROTOR CHAMBER THAT IS FORMED BETWEEN UPPER AND LOWER CASES

FIELD OF THE INVENTION

The present invention relates to a vane pump.

BACKGROUND OF THE INVENTION

Conventionally, there is known a vane pump 1 as shown in FIG. 5A, which includes a rotor chamber 2, a rotor 3 eccentrically accommodated in the rotor chamber 2 and a plurality of vanes 4 attached to the rotor 3 for making sliding contact with an inner peripheral surface 2*a* of the rotor chamber 2 at their leading ends. As the rotor 3 is rotatably driven in the vane pump 1, working compartments 5 surrounded by inner surfaces of the rotor chamber 2, an outer peripheral surface 3*a* of the rotor 3 and the vanes 4 undergo a volume change and a working fluid drawn into the working compartments 5 from an inlet port 6 is discharged through an outlet port 7.

In such a vane pump 1, if the thrust surfaces of the rotor 3 and the inner surfaces of the rotor chamber 2 arranged in a mutually facing relationship are brought into surface-to-surface contact with each other over the nearly whole surfaces thereof as illustrated in FIG. 5B, an increased resistance against sliding movement is generated, thereby reducing rotation efficiency of the rotor 3. In contrast, if gaps "S" are left as illustrated in FIG. 5C to avoid direct contact between the thrust surfaces of the rotor 3 and the inner surfaces of the rotor chamber 2 arranged in a mutually facing relationship (see, e.g., Japanese Utility Model Laid-Open Application No. 58-189388 and 62-179382), a problem is posed in that the working fluid in the working compartments 5 is leaked through the gaps "S" according to a change in internal pressure.

SUMMARY OF THE INVENTION

In view of the foregoing, the present invention provides a vane pump capable of avoiding reduction in rotation efficiency of a rotor while preventing a working fluid from being leaked out of working compartments.

In accordance with an embodiment of the present invention, there is provided a vane pump including: a rotor chamber; a rotor eccentrically accommodated in the rotor chamber; a plurality of vanes attached to the rotor, each of the vanes having a leading end adapted to make sliding contact with an inner peripheral surface of the rotor chamber; working compartments surrounded by inner surfaces of the rotor chamber, an outer peripheral surface of the rotor and the vanes, the working compartments adapted to undergo a volume change as the rotor is rotatably driven; an inlet port through which a working fluid is drawn into a working compartment whose volume is being increased; and an outlet port through which the working fluid is discharged from a working compartment whose volume is being decreased.

Further, an engaging portion is formed in a peripheral end portion of a thrust surface of the rotor to extend along a circumferential direction of the rotor and an engaged portion with which the engaging portion engages in a non-contact state is formed in an inner surface region of the rotor chamber facing the thrust surface of the rotor in a non-contact state to follow a trajectory of the peripheral end portion of the thrust surface of the rotor. This makes it possible to form a labyrinth seal portion, which includes the engaging portion and the engaged portion interlocking with each other in a non-contact state, between the peripheral end portion of the thrust surface of the rotor and the inner surface region of the rotor chamber facing the thrust surface of the rotor. Thus, the rotor and the rotor chamber can be kept in a non-contact state to thereby avoid reduction in rotation efficiency of the rotor and, in addition, it is possible for the labyrinth seal portion to prevent the working fluid from being leaked out of the working compartments.

Preferably, the engaging portion is formed over an extent ranging from the peripheral end portion of the thrust surface of the rotor to an axis-side end portion of the thrust surface, and the engaged portion with which the engaging portion engages in a non-contact state is formed in the inner surface region of the rotor chamber facing the thrust surface of the rotor in a non-contact state. Thus, the labyrinth seal portion, which consists of the engaging portion and the engaged portion interlocking with each other in a non-contact state, can more effectively prevent the working fluid from being leaked out of the working compartments.

In accordance with the embodiment of the present invention, there is provided an advantage in that it is possible to avoid reduction in rotation efficiency of a rotor and also possible to prevent working fluid from being leaked out of working compartments.

BRIEF DESCRIPTION OF THE DRAWINGS

The objects and features of the present invention will become apparent from the following description of embodiments, given in conjunction with the accompanying drawings, in which.

DETAILED DESCRIPTION OF THE PREFERRED EMBODIMENTS

Figure 1A:
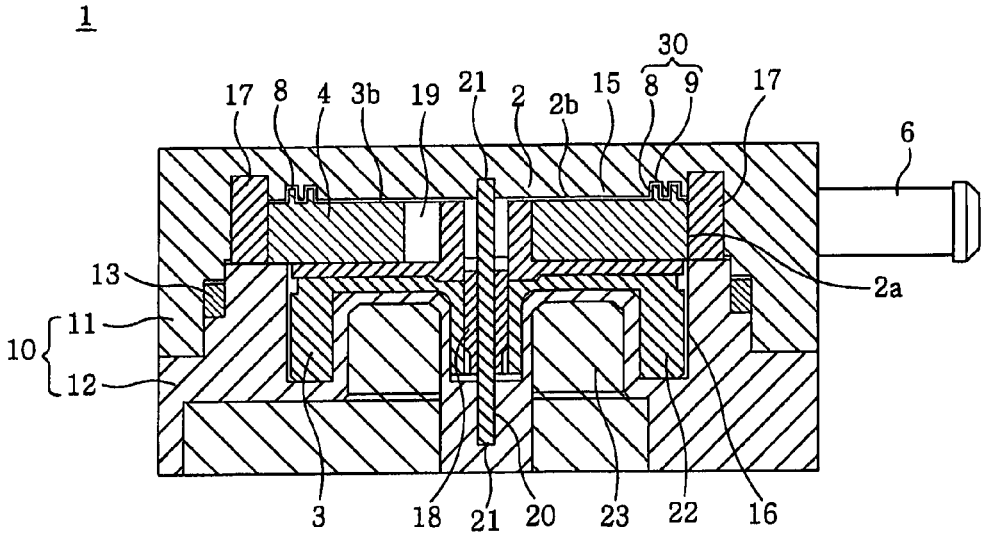
FIG. 1A is a vertical cross sectional view taken along the line A-A in FIG. 3 showing major parts of a vane pump in accordance with an embodiment of the present invention and FIG. 1B is another vertical cross sectional view thereof taken along the line B-B in FIG. 3.
Figure 1B:
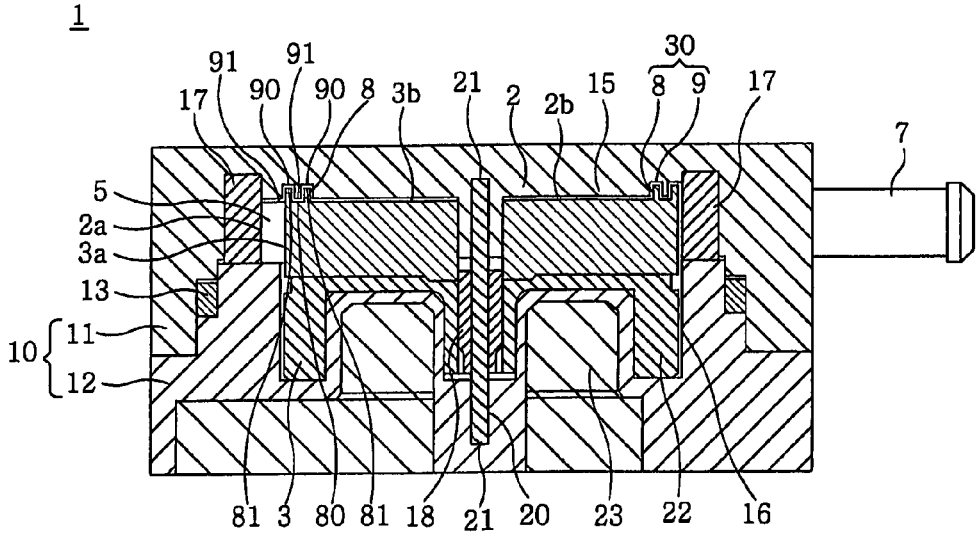
Figure 2:
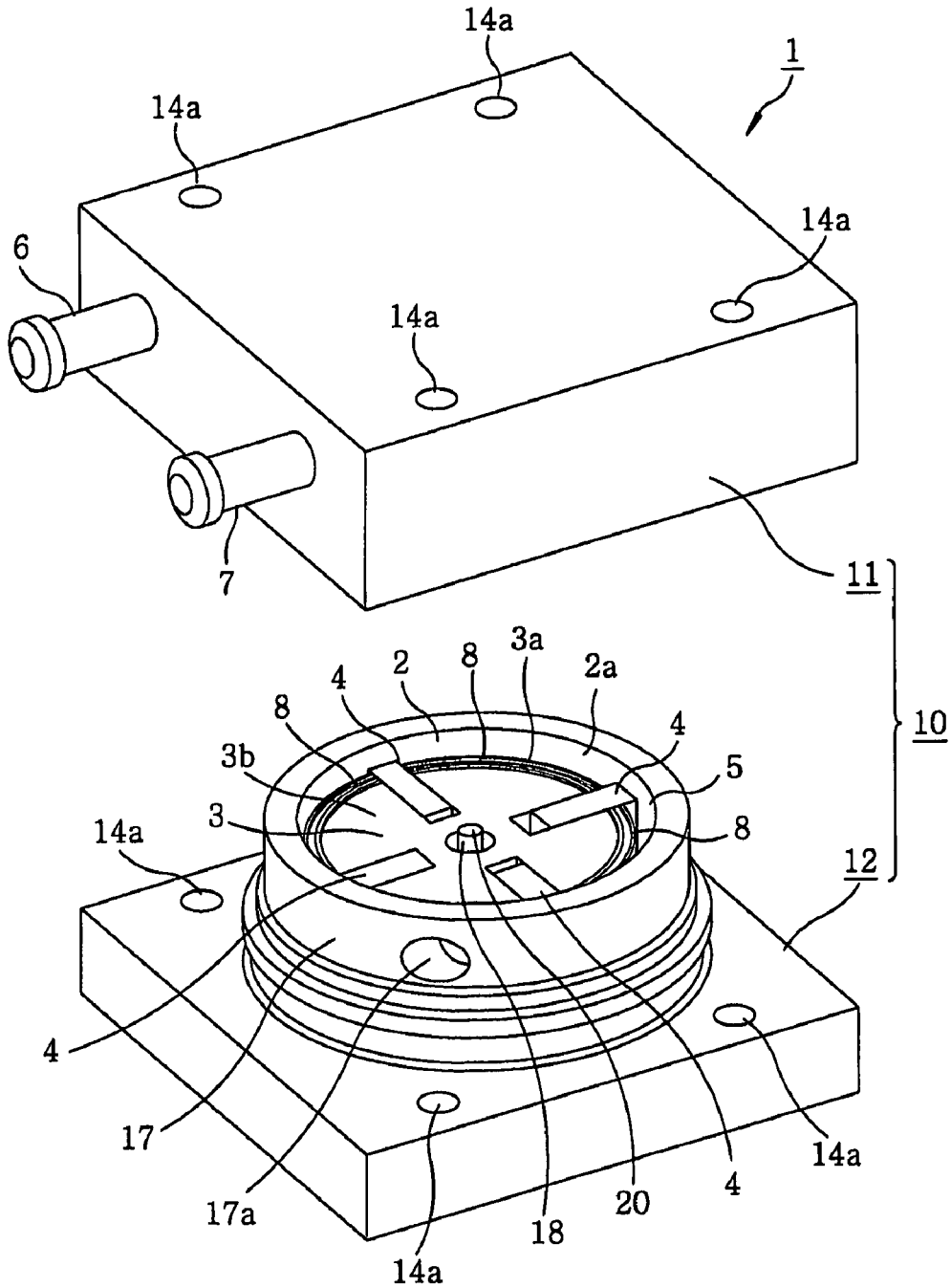
FIG. 2 is an exploded perspective view of the vane pump shown in FIG. 1.
Figure 3:
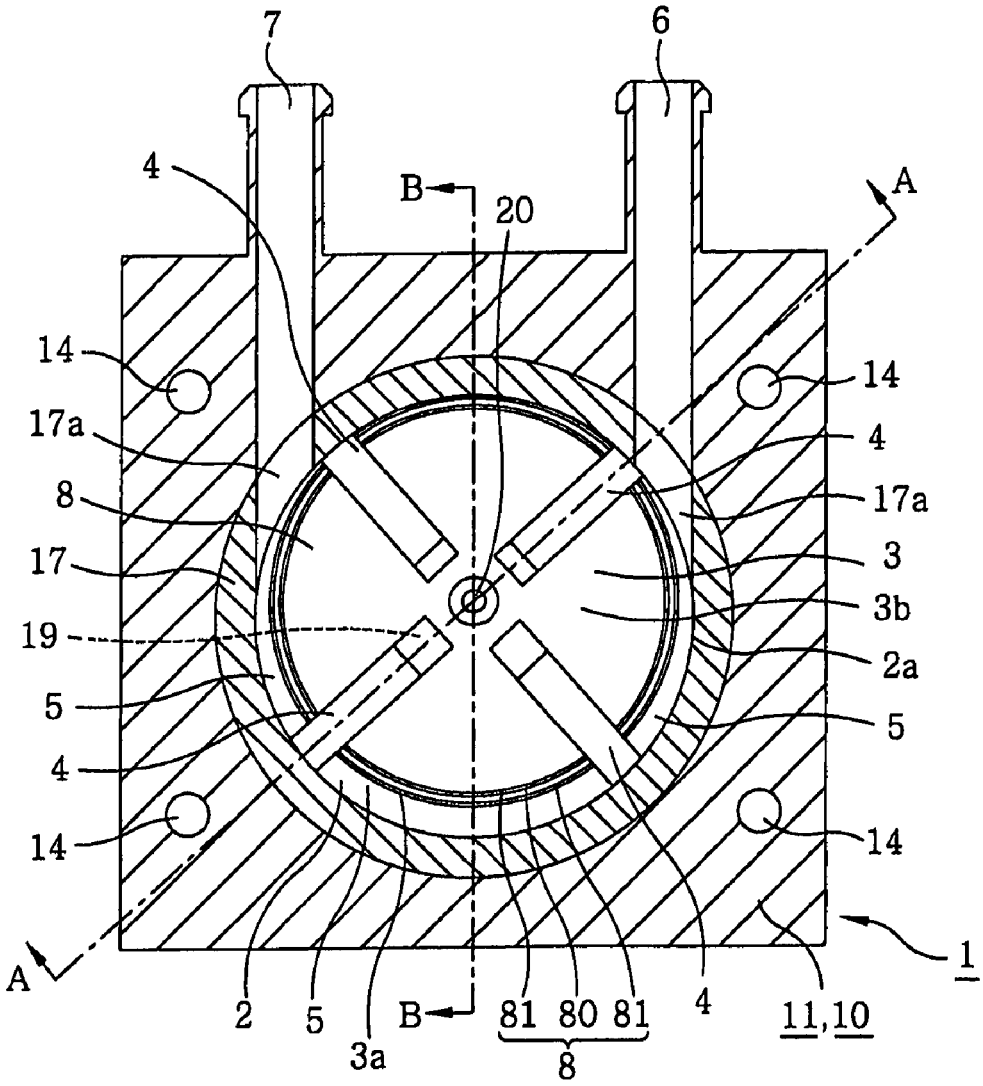
FIG. 3 is a schematic horizontal sectional view of the vane pump shown in FIG. 1.

Hereinafter, preferred embodiments of the present invention will now be described with reference to the accompanying drawings.

The vane pump 1 shown in FIGS. 1A to 3 in accordance with an embodiment of the present invention includes a casing 10 having a rotor chamber 2 in which a rotor 3 is accommodated eccentrically. A plurality of vanes 4 each having a leading end that makes sliding contact with an inner peripheral surface 2*a* of the rotor chamber 2 is mounted to the rotor 3. The casing 10 is provided with an inlet port 6 and an outlet port 7 leading to the rotor chamber 2. As the rotor 3 is rotatably driven, working compartments 5 surrounded by inner surfaces of the rotor chamber 2, an outer peripheral surface 3*a* of the rotor 3 and the vanes 4 undergo a volume change and a working fluid drawn into the working compartments 5 from the inlet port 6 is discharged through the outlet port 7. Such a configuration of the vane pump 1 will be described in detail hereinbelow.

The casing 10 is formed of an upper case 11 and a lower case 12*a*, both of which are combined together with a packing 13 interposed therebetween. Reference numeral 14*a* in FIG. 2 designates fastener holes through which fasteners are inserted to couple the upper case 11 and the lower case 12 together. The upper case 11 has an upper recess 15 upwardly recessed from a coupling surface thereof coupled to the lower case 12. The lower case 12 has a lower recess 16 downwardly recessed from a coupling surface thereof coupled to the upper case 11. The upper recess 15 and the lower recess 16 are combined together to form the rotor chamber 2.

When the rotor 3 is disposed in the rotor chamber 2, the rotor 3 has an upper portion positioned in the upper recess 15 and a lower portion lying in the lower recess 16. The upper recess 15 has an inner diameter greater than an outer diameter of the rotor 3, and the lower recess 16 has an inner diameter substantially the same as the outer diameter of the rotor 3. In other words, the lower recess 16 is formed to have an inner diameter smaller than that of the upper recess 15, so that, when the upper case 11 and the lower case 12 are combined together, the lower recess 16 is positioned eccentrically from the upper recess 15 just like the rotor 3. A ring member 17 is fitted to an inner peripheral portion of the upper recess 15 in such a way that an inner peripheral surface of the ring member 17 forms the inner peripheral surface 2*a* of the rotor chamber 2.

Although the rotor chamber 2 has a circular cross section when viewed in the thrust direction of the rotor 3, the inner peripheral surface 2*a* may be readily changed into an arbitrary shape such as an elliptical shape or the like when seen in the thrust direction by varying the shape of the inner peripheral shape of the inner circumference of the ring member 17. Further, formed in the upper case 11 are the inlet port 6 through which the working fluid is drawn into the working compartments 5 and the outlet port 7 through which the working fluid is discharged from the working compartments 5. The inlet port 6 and the outlet port 7 are in communication with the rotor chamber 2, i.e., the working compartments 5, via though-holes 17*a*. At a lower part of the lower case 12, there is arranged a stator 23 near an inner bottom surface of the lower recess 16.

The rotor 3 has a central bearing portion 18 and is formed into a circular shape when seen in the thrust direction. A plurality of (four, in the present embodiment) vane grooves 19 are radially formed in an upper portion of the rotor 3 and a magnetic body 22 made of magnet is integrally attached to a lower portion of the rotor 3. The bearing portion 18 of the rotor 3 is rotatably fitted to a rotating shaft 20 vertically extending through the rotor chamber 2, whereby the rotor 3 is rotatably arranged within the rotor chamber 2 in such a fashion that the outer peripheral surface 3*a* of the rotor 3 faces the inner peripheral surface 2*a* of the rotor chamber 2 and the thrust surface (top surface 3*b*) of the rotor 3 faces an inner ceiling surface 2*b* of the rotor chamber 2, which is a bottom surface of the upper recess 15. The rotating shaft 20 is non-rotatably secured to shaft fixing portions 21 provided at an off-centered position of the inner ceiling surface 2*b* of the rotor chamber 2 and a central position of the inner bottom surface of the lower recess 16.

Further, the vanes 4 are inserted into the respective vane grooves 19 of the rotor 3 so that the vanes 4 can slidably move in the radial direction of the rotor 3. Thus, the respective vanes 4 are free to protrude above and retreat below the outer peripheral surface 3*a* of the rotor 3.

The magnetic body 22 and the stator 23 are placed adjacent to other when the rotor 3 is arranged in the rotor chamber 2. The magnetic body 22 and the stator 23 constitute a driving part for rotationally driving the rotor 3. In other words, when an electric current is inputted to the stator 23 from a power source (not shown), the driving part generates a torque by the magnetic interaction between the stator 23 and the magnetic body 22. The magnetic body 22 and the rotor 3 are rotatably driven by the torque thus generated.

As the rotor 3 accommodated in the rotor chamber 2 is rotatably driven by the driving part, the respective vanes 4 are protruded radially outward from the outer peripheral surface 3*a* of the rotor 3 under the influence of a centrifugal force exerted by rotation of the rotor 3. Therefore, the leading ends of the vanes 4 can make sliding contact with the inner peripheral surface 2*a* of the rotor chamber 2. Thus, the rotor chamber 2 is divided into a plurality of the working compartments 5, each of which is surrounded by the inner surfaces (the inner peripheral surface 2*a*, the inner ceiling surface 2*b*, etc.) of the rotor chamber 2, the outer peripheral surface 3*a* of the rotor 3 and the vanes 4. Since the rotor 3 is arranged at an eccentric position in the rotor chamber 2, the distance between the inner peripheral surface 2*a* of the rotor chamber 2 and the outer peripheral surface 3*a* of the rotor 3 varies with the angular positions of the rotor 3 and, similarly, the protruding amount of the vanes 4 relative to the rotor 3 varies depending on the angular positions of the rotor 3.

In other words, the rotation of the rotor 3 moves the respective working compartments 5 in the rotating direction of the rotor 3, during which time the volume of each working compartment 5 is varied between its lower and upper limits. That is, when each of the working compartments 5 is positioned to communicate with the inlet port 6, the volume thereof is increased with the rotation of the rotor 3. When each of the working compartments 5 is positioned to communicate with the outlet port 7, the volume thereof is reduced with the rotation of the rotor 3. Therefore, if the rotor 3 is rotatably driven, the working fluid is drawn into the working compartment 5 communicating with the inlet port 6 and then is pressurized in the working compartment 5, to thereby discharge the working fluid through the outlet port 7. This realizes the function of a pump.

In the meantime, the vane pump 1 of the present embodiment is designed to avoid reduction in rotation efficiency of the rotor 3, while preventing leakage of the working fluid out of the working compartments 5. Description will now be given in this regard.

Specifically, an engaging portion 8 is formed at a peripheral end portion of a thrust surface of the rotor 3 (a top surface 3*b* of the rotor 3) to extend along a circumferential direction of the rotor 3 and an engaged portion 9 for receiving or matching with the engaging portion 8 in a non-contact state is formed on the inner surface region (an ceiling surface 2*b* of the rotor chamber 2) facing the thrust surface of the rotor 3 in a non-contact state to follow a trajectory of the peripheral end portion of the thrust surface of the rotor 3.

More specifically, the engaging portion 8 formed on the top surface 3*b* of the rotor 3 has a recessed section 80 and a pair of raised sections 81 alternately formed along a radial direction, both of the recessed and raised sections extending in the circumferential direction of the rotor 3. Furthermore, the engaged portion 9 formed on the ceiling surface 2*b* of the rotor chamber 2 has a raised section 91 inserted into the recessed section 80 of the engaging portion 8 in a non-contact state, and a pair of recessed sections 90 into which the raised sections 81 of the engaging portion 8 are inserted in a non-contact state, each of the raised section 91 and the recessed sections 90 having an endless strip shape when seen in the thrust direction. The raised section 91 and the recessed sections 90 of the engaged portion 9 are formed alternately in the radial direction. That is, the raised sections 81 and the recessed section 80 therebetween of the engaging portion 8 are disposed coaxially with respect to the center of rotation of the rotor 3. The recessed section 80 may be or may not be flush with the flat portion of the top surface 3*b* of the rotor 3. Each of the raised sections 81 may be preferably formed of a single ring-shaped protrusion; but it can be formed of circumferentially arranged multiple separated protrusions. Further, the number of the raised sections 81 and that of the recessed section 80 need not be necessarily 2 and 1, as in this example; but they can be varied when necessary. Likewise, the recessed sections 90 and the raised section 91 therebetween of the engaged portion 9 are disposed coaxially with respect to the center of rotation of the rotor 3. The raised section 91 may be or may not be flush with the flat portion of the ceiling surface 2*b* of the rotor chamber 2. The raised section 91 may be preferably formed of a single ring-shaped protrusion; but it can be formed of circumferentially arranged multiple separated protrusions.

Thus, a corrugated tiny gap having an increased flow resistance extends a relatively long distance, consequently providing a labyrinth seal portion 30 that exhibits improved sealing performance. By the labyrinth seal portion 30 provided between the top surface 3*b* of the rotor 3 and the ceiling surface 2*b* of the rotor chamber 2 kept in a mutually facing relationship, the rotor 3 and the rotor chamber 2 can be kept in a non-contact state to thereby avoid reduction in rotation efficiency of the rotor 3 and, in addition, it is possible for the labyrinth seal portion 30 to prevent the working fluid from being leaked out of the working compartments 5.

Figure 4A:
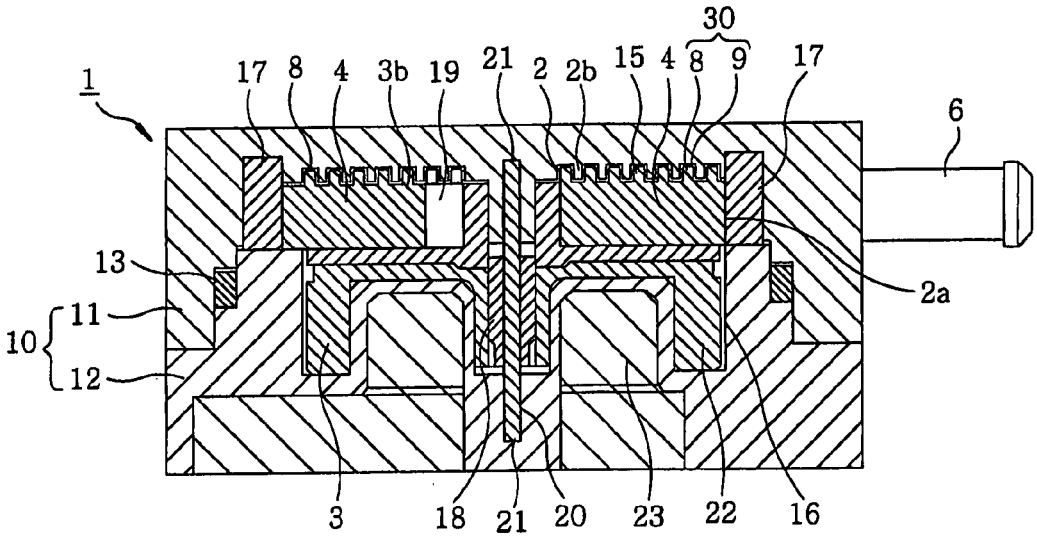
FIGS. 4A and 4B are vertical cross sectional views showing major parts of a vane pump in accordance with another embodiment of the present invention.
Figure 4B:
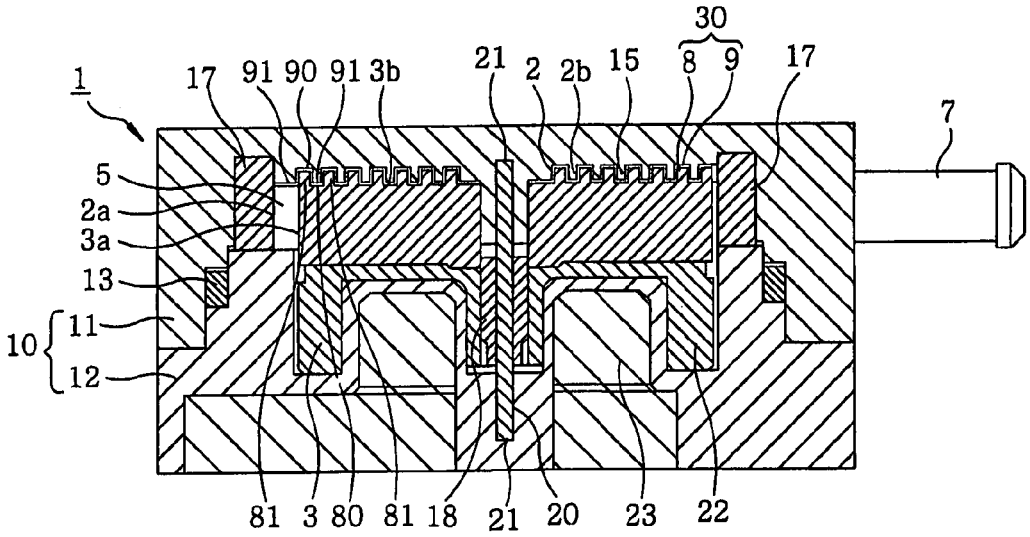

FIGS. 4A and 4B show a vane pump in accordance with another embodiment of the present invention. In this embodiment, an engaging portion 8 is formed over an extent ranging from the peripheral end portion of the thrust surface of the rotor 3 to an axis-side end portion of the thrust surface. Further, an engaged portion 9 with which the engaging portion 8 engages in a non-contact state is formed on the inner surface region (the ceiling surface 2*b*) of the rotor chamber 2 facing the thrust surface of the rotor 3 in a non-contact state.

In other words, the engaging portion 8 formed on the top surface 3*b* of the rotor 3 includes circumferentially extending recessed sections 80 and circumferentially extending raised sections 81, both of which are formed over a substantially entire portion of the top surface 3*b* of the rotor 3 and arranged alternately in a radial direction of the rotor 3. That is, the part of the top surface 3*b* of the rotor 3 on which the engaging portion 8 is formed has a corrugated shape formed of alternately arranged ring-shaped coaxial recessed and raised sections 80 and 81.

The engaged portion 9 formed on the ceiling surface 2*b* of the rotor chamber 2 has raised sections 90 and recessed sections 91, both of which are alternately formed over a substantially entire portion of the surface portion of the rotor chamber 2 facing the top surface 3*b* of the rotor 3, each of the raised sections 90 and the recessed sections 91 preferably having an endless strip shape, i.e., ring shape when seen in a thrust direction. In other words, a labyrinth seal portion 30 is formed over an extent ranging from an axis-side end portion to a peripheral end portion of the thrust surface of the rotor 3 (the top surface 3*b* of the rotor 3). Accordingly, the labyrinth seal portion 30 thus created can more effectively prevent the working fluid from being leaked out of the working compartments 5.

Figure 5A:
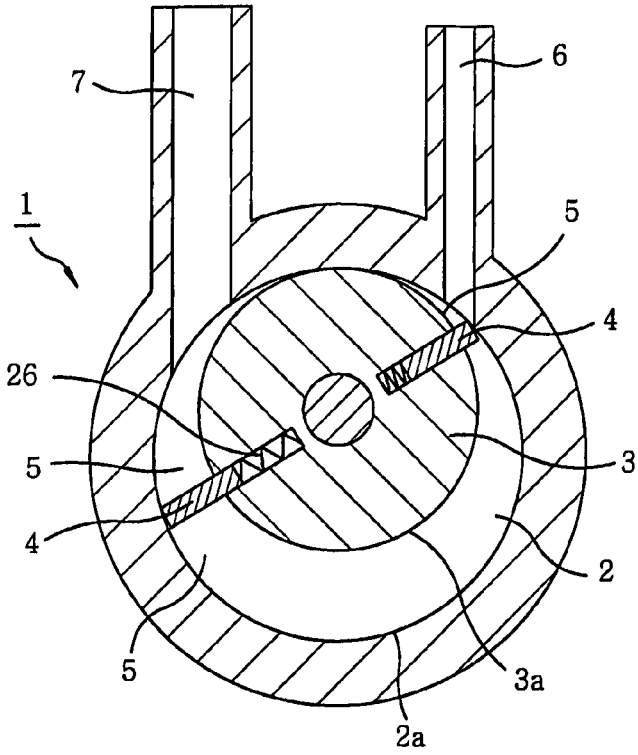
FIG. 5A (PRIOR ART)
FIG. 5A is a schematic horizontal cross sectional view of a prior art vane pump and FIGS. 5B and 5C are vertical cross sectional views of major parts of the prior art vane pump explaining problems thereof.
Figure 5B:
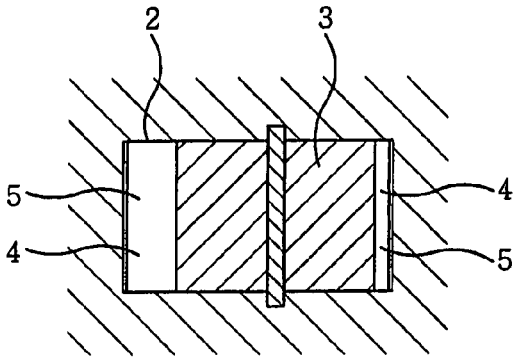
FIG. 5B (PRIOR ART)
Figure 5C:
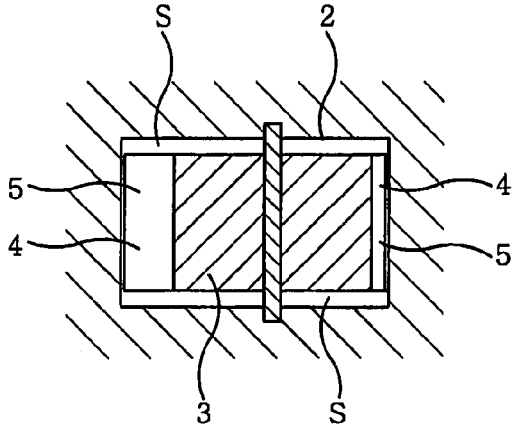
FIG. 5C (PRIOR ART)

In the embodiment described above, the vanes 4 are protruded outwardly by the centrifugal force exerted by the rotation of the rotor 3. However, spring members 26 (see FIG. 5) that outwardly bias the vanes 4 may be inserted into the vane grooves 19 to ensure that the leading ends of the vanes 4 can make reliable sliding contact with the inner peripheral surface 2*a* of the rotor chamber 2 without resort to the rotating speed of the rotor 3.

Moreover, in the embodiment described above, the rotor 3 is rotatably fitted to a fixed shaft 20. However, it may be possible to employ a structure in which a rotating shaft fixed to the rotor 3 is rotatably fitted with respect to the rotor chamber 2 instead of the fixed shaft 20.

Further, in the embodiment described above, the driving part for rotatably driving the rotor 3 is formed of the stator 23 and the magnetic body 22 that magnetically interact with each other. However, it may be possible to employ, as the driving part, a structure in which a shaft fixed to the rotor 3 is rotatably driven by an electric motor.

While the invention has been shown and described with respect to the embodiments, it will be understood by those skilled in the art that various changes and modification may be made without departing from the scope of the invention as defined in the following claims.

What is claimed is:

1. A vane pump comprising:

a rotor chamber;

a rotor eccentrically accommodated in the rotor chamber;

a plurality of vanes attached to the rotor, each of the vanes having a leading end adapted to make sliding contact with an inner peripheral surface of the rotor chamber;

working compartments surrounded by inner surfaces of the rotor chamber, an outer peripheral surface of the rotor, and the vanes, the working compartments being adapted to undergo a volume change as the rotor is rotatably driven;

an inlet port through which a working fluid is drawn into a working compartment whose volume is being increased;

an outlet port through which the working fluid is discharged from a working compartment whose volume is being decreased;

a casing comprised of a first case having a first recess and a second case having a second recess, the second recess having an inner diameter smaller than an inner diameter of the first recess, wherein the first and the second recesses form the rotor chamber; and a labyrinth seal portion formed between a bottom surface of the first recess and a surface of the rotor facing the bottom surface of the first recess, the labyrinth seal portion including at least one pair of a protrusion section and a recessed section extending along a circumferential direction of the rotor and having a gap therebetween.

2. The vane pump of claim 1, wherein the labyrinth seal portion is formed over a substantially entire portion of the surface of the rotor facing the bottom surface of the first recess.

3. The vane pump of claim 2, further comprising:

a magnetic body integrally attached to a portion of the rotor disposed in the second recess; and a stator arranged near an inner bottom surface of the second recess, wherein the magnetic body and the stator constitute a driving part for rotationally driving the rotor.

4. The vane pump of claim 3, wherein the magnetic body is disposed in the second recess and the vanes are disposed in the first recess.

5. The vane pump of claim 4, wherein the inlet port and the outlet port face a same direction.

6. The vane pump of claim 3, wherein the inlet port and the outlet port face a same direction.

7. The vane pump of claim 2, wherein the inlet port and the outlet port face a same direction.

8. The vane pump of claim 1, further comprising:

a magnetic body integrally attached to a portion of the rotor disposed in the second recess; and a stator arranged near an inner bottom surface of the second recess, wherein the magnetic body and the stator constitute a driving part for rotationally driving the rotor.

9. The vane pump of claim 8, wherein the magnetic body is disposed in the second recess and the vanes are disposed in the first recess.

10. The vane pump of claim 9, wherein the inlet port and the outlet port face a same direction.

11. The vane pump of claim 8, wherein the inlet port and the outlet port face a same direction.

12. The vane pump of claim 1, wherein the inlet port and the outlet port face a same direction.

* * * * *